US012043960B2

(12) United States Patent
Kockritz et al.

(10) Patent No.: US 12,043,960 B2
(45) Date of Patent: Jul. 23, 2024

(54) LAMINATED PAPER MACHINE CLOTHING

(71) Applicant: FIRST QUALITY TISSUE SE, LLC, Great Neck, NY (US)

(72) Inventors: Uwe Kockritz, Heidenheim (DE); Jens Kallenberg, Herbrechtingen (DE); Petra Hack-Ueberall, Langenau-Horvelsingen (DE); Gregory Allen Elliott, Cincinnati, OH (US); Thomas Anthony Hensler, Cincinnati, OH (US); James E. Sealy, II, Belton, SC (US); Marc Paul Begin, Simpsonville, SC (US)

(73) Assignee: FIRST QUALITY TISSUE SE, LLC, Great Neck, NY (US)

( * ) Notice: Subject to any disclaimer, the term of this patent is extended or adjusted under 35 U.S.C. 154(b) by 0 days.

(21) Appl. No.: 17/982,645

(22) Filed: Nov. 8, 2022

(65) Prior Publication Data

US 2023/0063085 A1 Mar. 2, 2023

Related U.S. Application Data

(63) Continuation of application No. 17/250,224, filed as application No. PCT/EP2019/065940 on Jun. 18, 2019, now Pat. No. 11,505,898.

(30) Foreign Application Priority Data

Jun. 20, 2018 (DE) ..... 10 2018 114 748.1

(51) Int. Cl.
*D21F 1/00* (2006.01)

(52) U.S. Cl.
CPC ..... *D21F 1/0045* (2013.01)

(58) Field of Classification Search
CPC ..... D21F 1/0045; D21F 11/06; D21F 1/0036; D21F 1/00; D21F 3/00; D21F 7/00; B32B 5/00
See application file for complete search history.

(56) References Cited

U.S. PATENT DOCUMENTS

2005/0167062 A1* 8/2005 Herman ..... D21F 1/0036 162/358.3
2018/0119347 A1* 5/2018 Brent, Jr. ..... D21F 1/0063

* cited by examiner

*Primary Examiner* — Jacob T Minskey
*Assistant Examiner* — Matthew M Eslami
(74) *Attorney, Agent, or Firm* — Amster, Rothstein & Ebenstein LLP

(57) ABSTRACT

The invention relates to a clothing (10) for a machine to manufacture or refine a fibrous web, in particular a paper, cardboard, or tissue web, comprising a substrate (40) and a grid structure (20) applied on the substrate (40), on which the fibrous web is transported when the clothing (10) is used as intended, wherein the grid structure (20') comprises a plurality of first elements (24'), all of which aligned in a first direction, and a plurality of second elements (26'), all of which aligned in a second direction, which is different from the first direction, wherein the first elements (24') penetrate the second elements (26'), forming the grid structure (20'), such that an underside of the first elements (24') facing the substrate (40) and an underside of the second elements (26') facing the substrate (40) are located in a common plane. In addition, the present invention relates to a method for producing such a clothing.

12 Claims, 2 Drawing Sheets

LAMINATED PAPER MACHINE CLOTHING

Figure 1:
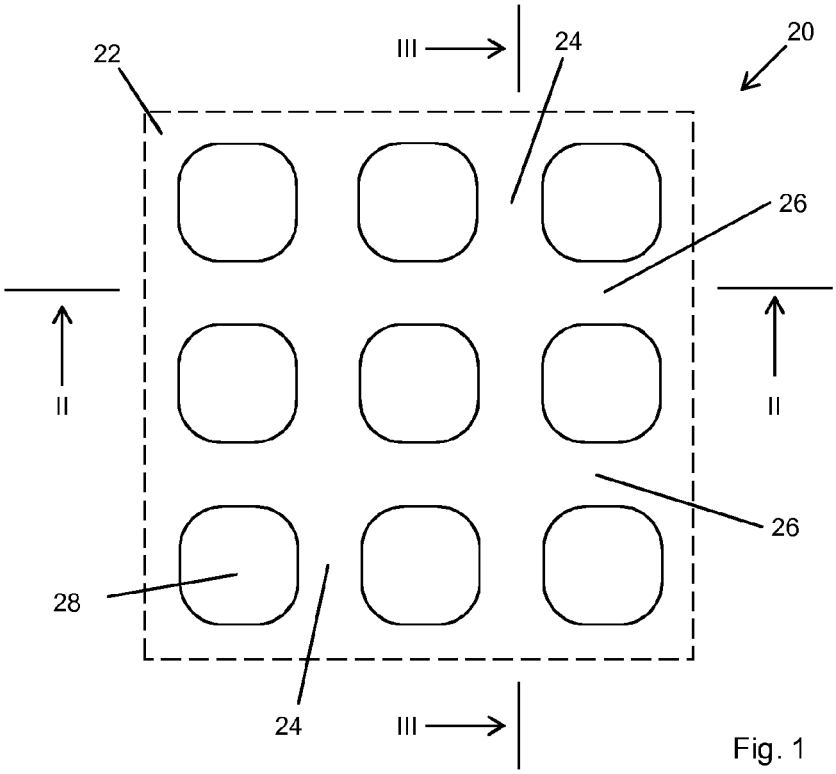

The invention relates to a clothing for a machine for producing or refining a fibrous web, in particular a paper, cardboard, or tissue web, comprising a substrate and a grid structure applied on said substrate, on which the fibrous web is transported when used as intended, with the grid structure comprising a plurality of first elements, all of which being aligned in a first direction, and a plurality of second elements, all of which being aligned in a second direction, which differs from the first direction.

Such a clothing is known from WO 2017/139786 A1. In the clothing described in WO 2017/139786 A1, the substrate formed from a web and the applied grid structure are connected to each other in such a way that air channels are formed in the plane between the substrate and grid structure.

It is disadvantageous in the clothing known from the prior art that the connection of the grid structure on the substrate is not optimal, or here a correspondingly stable connection must be achieved using extensive bonding procedures.

The object of the present invention is to provide a clothing which allows to generate a reliable connection between the substrate and the grid structure in a simple way.

The objective is attained according to the invention by an embodiment as described in claim 1, as well as by means of a manufacturing method for such a clothing according to claim 10. Other advantageous features of the embodiment according to the invention are discernible from the dependent claims. According to the invention, the generic clothing described at the outset is characterized in that the first elements penetrate the second elements, hereby forming the grid structure, in such a way that an underside of the first elements facing the substrate and an underside of the second elements facing the substrate are located in a common plane. Unlike the method of prior art described at the outset, both the first elements and the second elements provide on their respective undersides a contact surface, via which the connection of the grid structure to the substrate can occur. A correspondingly large contact surface allows to achieve a reliable connection of the grid structure to the substrate, even with relatively simple means, such as in particular by means of an adhesive. A reliable connection is of great importance so that the clothing is prevented from prematurely failing, particularly separating, during the intended operation of the machine in which it is exposed to strong and changing loads.

As all surfaces naturally have a certain roughness and, moreover, the grid structure is subject to manufacturing tolerances, it is to be understood under the term "common plane" in the meaning of the present invention that the underside of the first elements and the underside of the second elements are to be in a tolerance range, which shall deviate from the ideal plane by not more than 10%, preferably by not more than 5%, of the thickness of the grid structure. This way it should be ensured that, if the grid structure is designed flat on a level floor, both the undersides of the first elements as well as the undersides of the second elements touch the floor, wherein it is not necessary to apply any or only a small, area-wide distributed pressure of max. 10 $N/m^2$.

The term "penetrating" is to be broadly understood in the sense of the present invention. Essentially, it is important that the grid structure comprises oblong elements that cross each other. Preferably, the oblong elements are connected to each other at the intersections in a material-to-material fashion, in particular merged with each other. However, the grid structure can also be generated differently, for example integrally in one piece using a casting process.

In a variant of the present invention, it is suggested that an adhesive layer is arranged between the substrate and the grid structure, which connects the substrate with the grid structure, wherein the adhesive layer preferably comprises a moisture-curing thermoplastic material. Good results were also yielded in experiments with a reactive melt adhesive based on polyurethane. Such an adhesive is commercially offered under the number 716.8 from the company Kleiberit, for example. In particular, the reactive melting adhesive offered by the company Finna Kleiberit under number 704.6 and based on polyurethane has shown very good results.

In order to ensure that the connection of the grid structure to the substrate can also be reliably achieved with simple means, such as with an adhesive, it is further suggested that the first elements and the second elements provide a contact area in the joint plane, which is defined by the underside of the first elements and the second elements, which contact area is at least 40%, preferably at least 50%, further preferably at least 60%, of the area of the planar overall dimension of the grid structure. The contact area is preferably in the common plane.

It has proven particularly advantageous if a surface of the first elements facing away from the substrate and a surface of the second elements facing away from the substrate are not located in a common plane. This way, on the side of the grid structure facing away from the substrate, on which the fibrous web to be generated or processed is transported when used as intended, a structured surface develops with the help of which structures can be transferred to the fibrous web, which is particularly important for tissue.

Preferably, the first elements and/or the second elements show everywhere along the direction of their longitudinal extension substantially the same cross-section orthogonal in reference thereto. For example, this cross-section can be substantially rectangular or round or oval or combinations of these forms. The grid structure can therefore be produced in a particularly easy fashion. For example, the first elements and the second elements can be extruded and then connected to each other in order to form the structure described above.

Preferably, however, the first elements and the second elements have different heights. Thus, a distance between the underside and a top of the first elements can differ by at least 20%, preferably at least 30%, from a distance between the underside and a top of the second elements. In particular, the difference can range from 20% to 40%.

In principle, the grid structure can be formed exclusively from the first elements and the second elements. If the first direction and the second direction form an angle of 90°, here a rectangular grid structure results. If this angle deviates from 90°, then a diamond-like grid structure results.

In a variant of the present invention, however, it can also be provided that the grid structure comprises at least a plurality of additional elements, which are all aligned in a further direction, which is different from the first direction and the second direction, wherein preferably also an underside of the additional elements facing the substrate is located in a common plane, which is defined by the underside of the first elements and the underside of the second elements. For example, if the grid structure is formed from first elements, second elements, and third elements, the grid structure can be configured in a honeycomb shape.

The substrate is preferably a web consisting of warp threads and weft threads, in particular a single-layered web. However, the substrate can alternatively or additionally comprise at least one layer or ply, which is formed from a perforated film, in particular a punched film or laser-drilled film, a non-woven thread material, a felt, a spiral sieve, or a combination thereof. The substrate can here be formed predominantly or completely from PEZ and/or PPS and/or PA and/or PCTA.

The grid structure can comprise a TPU material and preferably be made from it. TPU represents here thermoplastic elastomers on a urethane basis. Alternatively, or additionally, the grid structure can include, for example, TPE, PET, and/or PP and/or PA, and/or be formed from it. Preferably, the material from which the grid structure is made can be easily extruded to simplify the manufacture of the grid structure.

The present invention also relates to a machine for producing or refining a fibrous web, in particular a paper, cardboard, or tissue web, comprising a clothing according to any of the preceding claims, wherein the clothing is preferably used as a structured TAD sieve in the machine. TAD stands for through-air dryers and such filters are used especially in the manufacture of tissue, which is used for example for toilet paper, facial tissues, etc.

Alternatively, the inventive clothing can be used as a so-called molding sieve in an Atmos machine of the company Finna Voith. Currently, woven and structured forming sieves are used for this application. By using the inventive clothing, depending on the construction of the grid structure, it is possible to increase the contact surface of the molding sieve to the Yankee cylinder. Further, with suitable material selection, the grid structure may show considerably more elastic properties than the woven, structured forming sieves of prior art. In this way, the contact area in the press gap can be increased noticeably due to compression features and elasticity, so that better drainage can take place in the press gap passage. Thus, higher dry contents can be achieved, the machine speed can be increased, and the production capacity as well as cost effectiveness of the system can be increased.

The inventive clothing in a NTT machine of the company Finna Valmet can be used, especially as a structured NTT web of such a machine. The structure of the paper web is here essentially determined by the embodiment of the grid structure. If a defined permeability of the finished clothing is to be achieved in the final application, it can be adjusted in addition to the design of the grid structure and the selection of the substrate, or alternatively by means of the quantity and type of the adhesive.

Furthermore, the inventive step can be used in the forming area of a conventional paper machine as a so-called forming sieve. In the process, the inventive clothing offers a variety of advantages in reference to conventional forming sieves, which are only woven. Thus, the inventive clothing can be manufactured more economically, because the production is less complex, usually requires fewer work steps, and can be standardized in a better fashion. Conventional forming sieves usually have relatively complex woven patterns. In addition, with the inventive clothing, compared to conventional forming sieves, faster dewatering can be achieved with consistent paper properties, as well as improved runability due to a clean run, because fewer cavities are present for fiber adhesion and/or contamination.

Also, the use of the inventive clothing as so-called marking belts is conceivable in different industrial applications.

According to the present invention, a method for producing the previously described clothing is proposed, in which the substrate and the grid structure are produced separately and then glued together.

In the process, adhesive can first be applied to the grid structure, preferably on the underside of the first elements facing the substrate and a underside of the second elements of the grid structure facing the substrate, before the grid structure is laminated on the substrate.

To achieve a viscosity of the adhesive, which allows it to reliably wet the underside of the first elements and the underside of the second elements, while leaving the apertures in the grid structure clear, it is suggested that prior to the application on the grid structure the adhesive is heated to a temperature above 100° C., preferably to a temperature from 110° C. to 130° C. Particularly when using a reactive melt adhesive based on polyurethane as the adhesive as described above, good results could be achieved when heating to these temperatures.

Furthermore, it is suggested in order to achieve good results that between 40 g/m$^2$ and 80 g/m$^2$ of the adhesive is applied to the grid structure, preferably between 45 g/m$^2$ and 55 g/m$^2$. On the one hand, a reliable connection of the grid structure on the substrate can be achieved and, on the other hand, a flow of excess adhesive into the openings of the grid structure is prevented.

The adhesive can here first be applied to a roller, which together with a counter roller forms a nip, through which the grid structure is guided out for wetting with the adhesive.

Alternatively, the adhesive can also be sprayed onto the grid structure to moisten it. Good results with a melting adhesive based on polyurethane could also be achieved here, as they are commercially sold, for example, under the number 704.6 or 716.8 by the company Finna Kleiberift©. Even when spraying on this adhesive, a full-surface wetting of the underside of the first elements and the underside of the second elements could be achieved without the adhesive reducing or even clogging the openings available in the grid structure.

The wetted grid structure can then be laminated on the substrate, on which preferably no adhesive has previously been applied, for example, by guiding the grid structure wetted with the adhesive, together with the substrate, through a roller nip. In principle, the grid structure can essentially comprise the same width as the substrate, or the grid structure can be formed more narrowly. In the latter case, several separate webs of the grid structure can be arranged next to each other on the substrate, or a continuous web can be applied spirally to the substrate.

Figure 3:
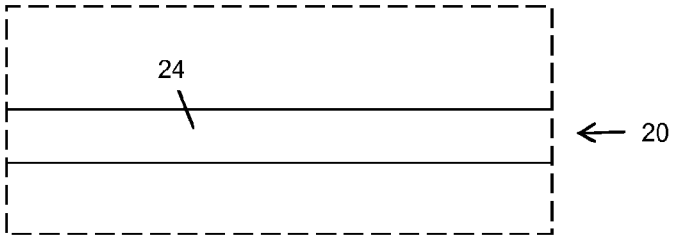
Figure 4:
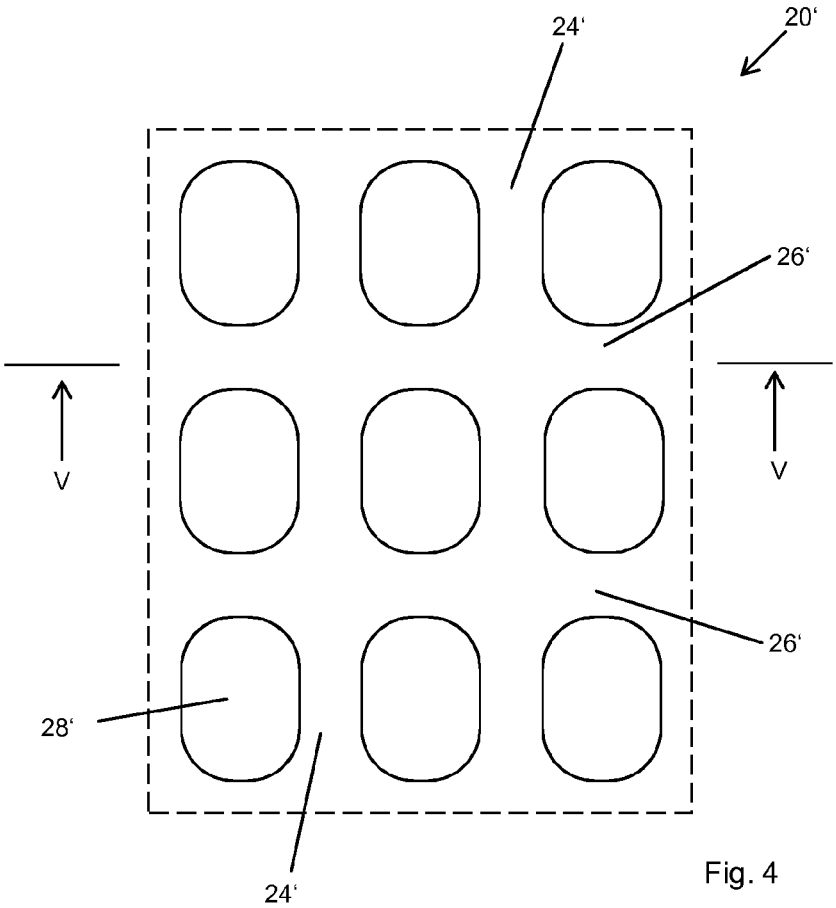

Based on exemplary embodiments, additional advantageous variants of the invention are explained with reference to the drawings. The features mentioned can be advantageously implemented not only in the combination shown, but also individually combined with each other. The non-scale figures show in detail:

FIG. 1A detail of a grid structure according to a first exemplary embodiment, FIG. 2A section through plane II-II in FIG. 1, FIG. 3A section through plane in FIG. 1, FIG. 4A detail of a grid structure according to a second exemplary embodiment, FIG. 5A section through plane V-V in FIG. 4, supplemented by an adhesive layer and a substrate.

The figures are described in more detail below. FIG. 1 shows a small detail of a grid structure 20, which is surrounded by a dashed line. Here, the direction of sight in FIG. 1 is focused on the underside 22 of the grid structure, i.e. on the side which faces the substrate 40 in the finished clothing (see FIG. 5). The grid structure 20 consists of a plurality of first elements 24, all of which are aligned parallel to each other and extend in FIG. 1 in a vertical direction, and a plurality of second elements 26, which are likewise formed parallel to each other and extend in the horizontal direction in FIG. 2. The first elements 24 and the second elements 26 penetrate each other in order to form the grid structure 20. The first elements 24 and the second elements 26 can be made from an extruded plastic, such as TPU, and then merged with each other to form a grid. In the present exemplary embodiment, the distance between the first elements 24 is constant and corresponds to the distance between the second elements 26, which is also constant. Thus, a regular arrangement of substantially rectangular, particularly square, openings 28 in the grid structure 20 results. Due to the manufacturing process, with which the first elements 24 and the second elements 26 are merged with each other, the openings 28 are not necessarily embodied with sharp edges, but can have slightly rounded corners, as shown in the present exemplary embodiment. The area, which is formed by an underside 30 of the first elements 24 and an underside 32 of the second elements 26, is substantially planar and represents in FIG. 1 at least 60% of the total area, i.e. the area which is surrounded by the dashed frame in FIG. 1. Thus, a sufficiently large contact area for a reliable connection of the grid structure 20 to the substrate 40 is also provided with simple means, such as an adhesive.

Figure 2:
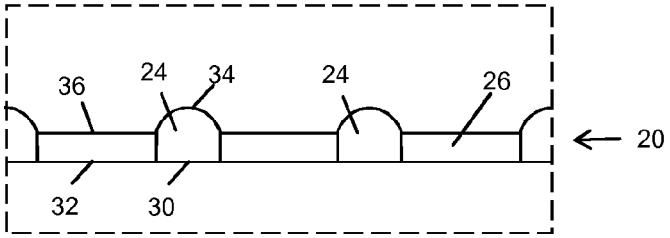

FIG. 2 shows a section through plane II-II in FIG. 1. Here, it can be seen that the first element 24 shows a greater thickness, i.e. dimension in a vertical direction in FIG. 2, than the second element 26. In other words, the measurement of the underside 30 is greater than a top 34 of the first element 24 than the measurement of the underside 32 to a top 36 of the second element 26. Because the underside 30 of the first element 24 and the underside 32 of the second element 26 lie in the same plane, a profiling of the top part of the grid structure 20 is yielded, which in the intended use of the clothing 10 (see FIG. 5) faces the fibrous web to be manufactured or to be refined. This profiling is advantageous to the fibrous web, which thus shows only the pattern of openings 28, but also the pattern of parallel grooves, that are yielded by the various heights of the first elements 24 and second elements 26. As can be seen in FIG. 2, the first elements 24 can have a cross-section orthogonal to its longitudinal direction of extension, which is rounded at the top, so that the top 24 of the first element 24 is formed only by a line which runs in the longitudinal direction of extension of the first element 24. The second element 26 can be configured this way, as well, although with lower height. Preferably, both the first elements 24 as well as the second elements 26 show a substantially equal cross-section everywhere along orthogonal in reference to the entire length of the longitudinal extension, wherein the material on the intersection points of the first elements 24 and the second elements 26 can run as already described before, which can lead to rounded corners of the openings 28.

FIG. 3 shows a section through plane III-III in FIG. 1. For reasons of simplicity, only the first element 24 is shown in this figure and not the second elements 26, which are completely merged in this sectional view with the first element 24.

FIG. 4 shows a view identical to FIG. 1, but illustrating a second embodiment of a grid structure 20'. Identical features of the second embodiment are equipped with identical reference signs as shown in the first embodiment, but showing an apostrophe. In this respect, reference is made to the above description.

The second embodiment differs from the first embodiment only in that the distance between the second elements 26' is greater than the distance between the first elements 24'. Thus, there are no substantially square, but rather essentially rectangular, openings 28' with an oblong shape.

Figure 5:
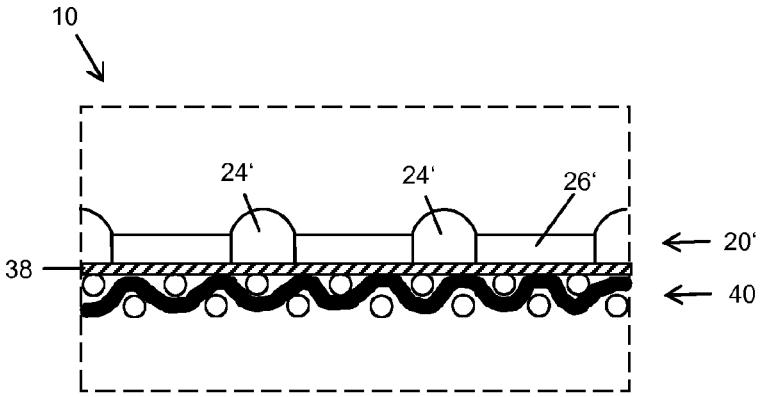

FIG. 5 shows a section through plane V-V in FIG. 4. This sectional view corresponds in the essential sectional view in FIG. 2 to the first embodiment. However, in FIG. 5, in addition to the grid structure 20', the substrate 40 is also shown, which consists in this exemplary embodiment of a single-layer fabric with wharf and weft threads and an adhesive layer 38 arranged between the grid structure 20' and the substrate 40. Thus FIG. 5 shows a section of the finished clothing 10 which is limited by a dashed frame.

The clothing 10 is produced by first generating the grid structure 20' and the substrate 40 separately. Then, the grid structure 20' is equipped with the adhesive layer 38 and then laminated onto the substrate.

Both in the first embodiment according to FIGS. 1-3, as well as in the second embodiment according to FIGS. 4 and 5, the first element 24, 24' extends preferably in the machine direction, when the clothing 10 is used as intended, and the second elements 26, 26' extend in the machine transverse direction. Alternatively, however, the first elements 24, 24' can extend in the machine transverse direction and the second elements 26, 26' in the machine direction.

LIST OF REFERENCE CHARACTERS

10 Clothing
20, 20' Grid structure
22 Underside of the grid structure
24, 24' first elements
26, 26' second elements
28, 28' Openings
30 Underside of the first elements
32 Underside of the second elements
34 Top of the first element
36 Top of the second element
38 Adhesive layer
40 Substrate

The invention claimed is:

1. A method of making a paper product comprising:

transporting a fibrous web on a multi-layer structured fabric to a press gap passage of a drying cylinder of a papermaking machine, the structured fabric comprising:

a substrate; and a grid structure applied on the substrate, the grid structure having higher elasticity than the substrate, the fibrous web being in direct contact with the grid structure while the fibrous web is transported on the multi-layer structured fabric, wherein the elasticity of the grid structure allows the grid structure to elastically deform in the press gap passage to enhance contact area between the fibrous web and the drying cylinder wherein the grid structure comprises a plurality of first elements all of which are aligned in a first direction, and a plurality of second elements all of which are aligned in a second direction which differs from the first direction, wherein the entire top side of each first element faces away from the substrate, and the entire top side of each second element faces away from the substrate, and the entire top sides of the first elements and the entire top sides of the second elements are not in a common plane so as to form a pattern of parallel grooves across the structured fabric.

2. The method of claim 1, wherein the drying cylinder is a Yankee dryer.

3. The method of claim 1, wherein the first elements are connected to the second elements at points where the first elements intersect the second elements.

4. The method of claim 1, wherein an underside of the first elements facing the substrate and an underside of the second elements facing the substrate are in a common plane.

5. The method of claim 1, wherein the plurality of first elements extend continuously across the structured fabric in the first direction and the plurality of second elements extend continuously across the structured fabric in the second direction.

6. The method of claim 1, wherein the structured fabric is a structured through-air-dryer (TAD) sieve.

7. The method of claim 4, wherein a top of the first elements facing away from the substrate and a top of the second elements facing away from the substrate are not in a common plane.

8. The method of claim 4, wherein a distance between the underside and a top side of the first elements differs by at least 20% from a distance between the underside and a top side of the second elements.

9. The method of claim 4, wherein the grid structure further comprises at least a plurality of third elements, all of which are aligned in a third direction, which is oriented differently in reference to the first direction and the second direction, wherein an underside of the third elements facing the substrate is located in the common plane, which is defined by the underside of the first elements and the underside of the second elements.

10. The method of claim 1, wherein the substrate is a web comprising warp threads and weft threads.

11. The method of claim 1, wherein the grid structure comprises thermoplastic polyurethane, polyethylene terephthalate, polypropylene, polyamide or combinations thereof.

12. A papermaking machine, comprising: a drying cylinder configured to dry a fibrous web; and a multi-layer structured fabric that transports the fibrous web to a press gap passage of the drying cylinder, the structured fabric comprising: a substrate; and a grid structure applied on the substrate, the grid structure having higher elasticity than the substrate, the grid structure configured for direct contact with the fibrous web while the fibrous web is transported on the multi-layer structured fabric, wherein the elasticity of the grid structure allows the grid structure to elastically deform in the press gap passage to enhance contact area between the fibrous web and the drying cylinder wherein the grid structure comprises a plurality of first elements all of which are aligned in a first direction, and a plurality of second elements all of which are aligned in a second direction which differs from the first direction, wherein the entire top side of each first element faces away from the substrate, and the entire top side of each second element faces away from the substrate, and the entire top sides of the first elements and the entire top sides of the second elements are not in a common plane so as to form a pattern of parallel grooves across the structured fabric.

* * * * *